United States Patent [19]

Maeda

[11] Patent Number: 4,806,035

[45] Date of Patent: Feb. 21, 1989

[54] PRINTER WITH SHEET GUIDE AND SEPARATOR

[75] Inventor: Tsuyoshi Maeda, Tokyo, Japan

[73] Assignee: Kabushiki Kaisha Toshiba, Kawasaki, Japan

[21] Appl. No.: 100,881

[22] Filed: Sep. 25, 1987

[30] Foreign Application Priority Data

Sep. 29, 1986 [JP] Japan ..... 61-147770[U]

[51] Int. Cl.[4] ..... B41J 13/14

[52] U.S. Cl. ..... 400/647.1; 400/642

[58] Field of Search ..... 400/647, 647.1, 616, 400/616.1, 642

[56] References Cited

U.S. PATENT DOCUMENTS 2,503,825 4/1950 Jambura ..... 400/647.1

FOREIGN PATENT DOCUMENTS 67073 4/1984 Japan ..... 400/642
229371 12/1984 Japan ..... 400/647.1
147369 8/1985 Japan ..... 400/647.1

*Primary Examiner*—Edgar S. Burr
*Assistant Examiner*—James Lisehora
*Attorney, Agent, or Firm*—Finnegan, Henderson, Farabow, Garrett & Dunner

[57] ABSTRACT

A printer includes a platen and a printing head which are covered with a cover. The cover includes a top plate and a rear plate extending substantially vertically from the rear end of the top plate. A cut sheet guide and a separator are rockably mounted on the top plate, respectively. In printing on a cut sheet, the guide is rocked to a feed position, wherein it is inclined at a predetermined angle to the top plate, and held therein by the separator. In printing on a continuous sheet, it is introduced into the cover through a continuous-sheet aperture formed in the rear plate, transported to the platen, and discharged toward the rear end of the top plate from a discharge aperture formed in the top plate. At this time, the guide is rocked to a discharge position wherein it is parallel to the top plate, and the separator is rocked to a separating position wherein it is parallel to the top plate and its distal end portion projects from the rear end of the top plate.

6 Claims, 3 Drawing Sheets

PRINTER WITH SHEET GUIDE AND SEPARATOR

BACKGROUND OF THE INVENTION

The present invention relates to a printer, and more particularly, to a printer capable of printing on both a cut sheet and a continuous sheet.

Conventionally, printers of this type comprise a platen and a printing head movable along the same. A printing sheet is wound around the platen when it is to be printed by the printing head. The platen, printing head, etc., are hidden by a cover. A cut-sheet guide is detachably mounted on the top face of the cover. The cut-sheet guide has a guide surface inclined at an angle to the top face of the cover. Inside the cover, a guide plate extends close to the platen, adjoining the guide surface. A cut sheet is guided to the platen by the cut-sheet guide and the guide plate. After the printing, it is transported along the cut-sheet guide again, to be discharged to the outside.

In printing on a continuous sheet, the sheet is inserted into the printer through a feed aperture in the rear face of the cover, and is fed to the platen by a tractor in the apparatus. After it is printed by the printing head, the continuous sheet is discharged through a discharge aperture in the top face of the cover, and is transported rearward along the top face. When using the continuous sheet, the cut-sheet guide is removed from the cover lest it hinder the discharge of the sheet.

In the conventional printer constructed in this manner, the cut-sheet guide must be attached to or detached from the cover, every time the printing mode is shifted between cut-sheet printing and continuous-sheet printing. Thus, the apparatus cannot enjoy high operating efficiency. When using a continuous printing sheet, moreover, the unprinted or supply-side portion of the sheet and the printed or discharge-side portion thereof come into contact with each other, at the back of the cover. Due to friction between these sheet portions, therefore, the sheet is subjected to an undesired load. In consequence, the continuous sheet cannot be fed steadily to the platen.

SUMMARY OF THE INVENTION

The present invention has been contrived in consideration of these circumstances, and is intended to provide a printer, enjoying high operating efficiency and capable of steadily feeding a continuous printing sheet.

In order to achieve the above object, a printing apparatus according to the present invention comprises a platen adapted to be wound with a printing sheet; a printing head located to face the platen and printing on the sheet wound on the platen; a cover arranged so as to hide the platen and the printing head, the cover including a top plate with a rear end, a rear plate, a discharge aperture, and a cut-sheet feed aperture, the apertures being situated close to the platen, the rear plate extending substantially vertically downward from the rear end of the top plate and having a continuous-sheet feed aperture, whereby the platen discharges the printed sheet toward the rear end of the cover through the discharge aperture; a cut-sheet guide for guiding the cut sheet to the platen through the cut-sheet feed aperture, the cut-sheet guide having a guide surface and being mounted on the top plate to be rockable around a pivotal point near the cut-sheet feed aperture, between a feed position, in which the guide surface is inclined at a predetermined angle to the top plate, and a discharge position, in which the guide surface is situated substantially parallel to the top plate; and a separator having a proximal end portion rockably mounted on the top plate, between the cut-sheet guide and the rear end of the top plate, and a distal end portion situated at a distance from the proximal end portion, the separator being rockable between a holding position, in which the distal end portion engages and holds the cut-sheet guide in the guide position, and a separating position, in which the distal end portion projects from the rear end of the top plate, thereby delivering the continuous sheet, discharged from the discharge aperture, to a position at a distance from the rear end of the top plate.

BRIEF DESCRIPTION OF THE DRAWINGS

FIGS. 1 to 6 show a printer according to an embodiment of the present invention, in which:

FIG. 1 is a front perspective view of the printer;

FIG. 2 is a rear perspective view of the printer;

FIG. 3 is a partially cutaway side view of the printer;

FIG. 4 is a plan view of the printer; and

FIGS. 5 and 6 are partially cutaway side views of the printer in states different from the state shown in FIG. 3.

DETAILED DESCRIPTION OF THE PREFERRED EMBODIMENTS

An embodiment of the present invention will now be described in detail with reference to the accompanying drawings.

Figure 1:
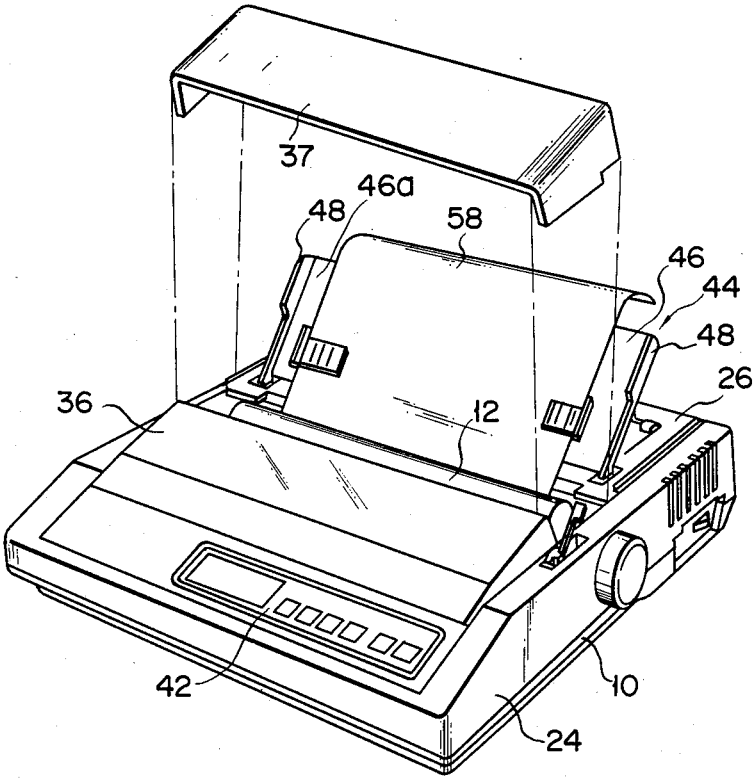
Figure 2:
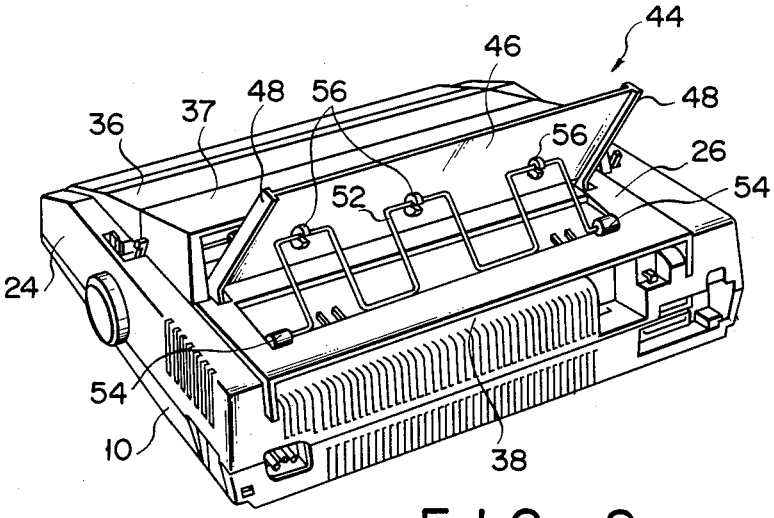
Figure 3:
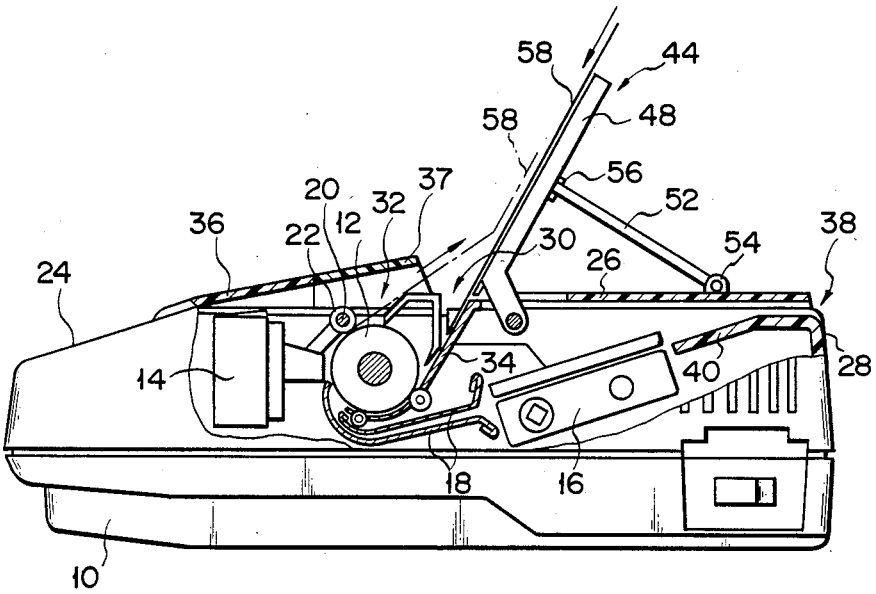

As shown in FIGS. 1 to 3, a printer comprises substantially rectangular body 10, which is provided with platen 12, extending in the transverse direction thereof, and printing head 14 movable along the platen. Body 10 is also provided with a pair of tractors 16 and a pair of guide plates 18. Tractors 16 serve to deliver a continuous printing sheet (mentioned later) to platen 12. Guide plates 18, which extend from their corresponding tractors to regions near the platen, serve to guide the tractor-fed continuous sheet. Numeral 20 designates a paper bail rod which is used to wind the sheet around platen 12. A plurality of paper bail rollers 22 are rotatably mounted on rod 20.

Body 10 is fitted with substantially rectangular main cover 24, which hides platen 12, printing head 14, tractor 16, etc. Cover 24 includes top plate 26, extending substantially horizontally, and rear plate 28 which extends substantially vertically downward from the rear end of the top plate. An opening is formed in that portion of top plate 26 which faces head 14 and platen 12. This opening defines cut-sheet feed aperture 30, through which cut sheets (mentioned later) are inserted into the inside space of cover 24, and discharge aperture 32, through which the printed sheets from head 14 are discharged to the outside of the cover. Cover 24 is provided with guide plate 34 which, extending close to platen 12 from feed aperture 30, serves to guide the cut sheets from the feed aperture to the platen. The greater part of the opening is closed by front cover 36 and dust cover 37 which are removably mounted on the top of main cover 24. Formed at the top of rear plate 28, moreover, is continuous-sheet feed aperture 38 through which the continuous sheet is fed into the inside space of cover 24. Also, cover 24 is formed with guide plate 40 which, extending close to tractors 16 from feed aperture 38, serves to guide the continuous sheet from the aperture 38 to the tractors. In FIG. 1, numeral 42 designates a control panel which is provided on the front end portion of the top of cover 24.

Cut-sheet guide 44 is rockably mounted on top plate 26 of cover 24. Guide 44 includes rectangular guide plate 46 and a pair of frames 48. Guide plate 46 has a width substantially equal to the length of platen 12. Frames 48 extend along two opposite side edges of guide plate 46. The lower end portion of each frame 48 projects into the inside space of cover 24 through top plate 26 of the cover, and is rockably supported by hinge 50 (FIG. 4) formed inside the cover. In this arrangement, guide 44 can rock relatively to cover 24, guide plate 46 is located parallel to platen 12, and the lower end edge of plate 46 is situated close to cut-sheet feed aperture 30.

Separator 52, which is formed of a comb-shaped wire, is located on top plate 26 of cover 24. Two opposite end portions of separator 52 are rockably supported by a pair of hinges 54, which are formed on top plate 26 and located between the rear end of plate 26 and cut-sheet feed aperture 30. Separator 52 has a width which is a little narrower than that of guide 44, and is located parallel thereto. The height of separator 52 and the positions of hinges 54 are adjusted so that the separator's height is shorter than the distance between aperture 30 and each hinge 54 and longer than the distance between each hinge 54 and the rear end of top plate 26. Thus, separator 52 can rock through 180° around hinges 54, over the top plate. Three engaging clicks 56 are formed on the back of guide plate 46 of guide 44. Top portions of separator 52 can be caught by clicks 56 for retention.

The operation of the printer, constructed in this manner, will now be described.

In printing on cut sheet 58, cut-sheet guide 44 is first rocked to a guiding position, as shown in FIGS. 1 to 3. In this position, the upper surface or guide surface **46*a* of guide plate 46 is flush with guide plate 34 of cover 24. Then, separator 52 is rocked to a holding position shown in FIGS. 2 and 3 such that the top portions thereof are caught by their corresponding engaging clicks 56. Thus, guide 44 is held in the guiding position. If cut sheet 58 is set on guide surface 46*a* of guide 44, in this state, it is guided to platen 12 by guide 44 and guide plate 34. After the printing, sheet 58 is discharged again onto guide 44 through discharge aperture 32, as indicated by a dot and dash line in FIG. 3**.

Figure 4:
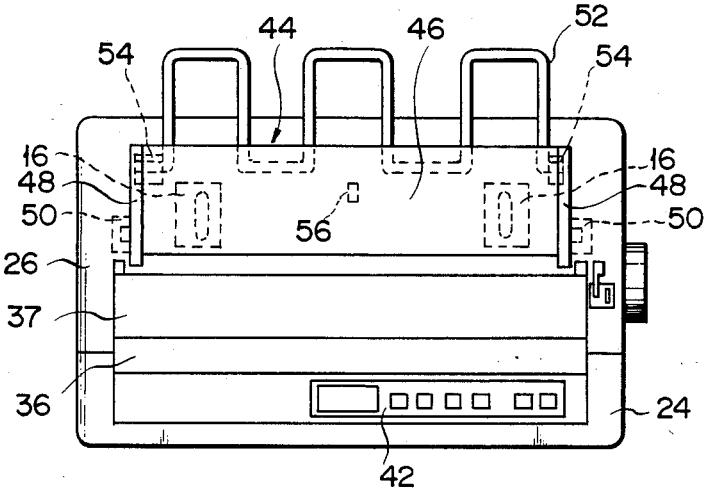
Figure 5:
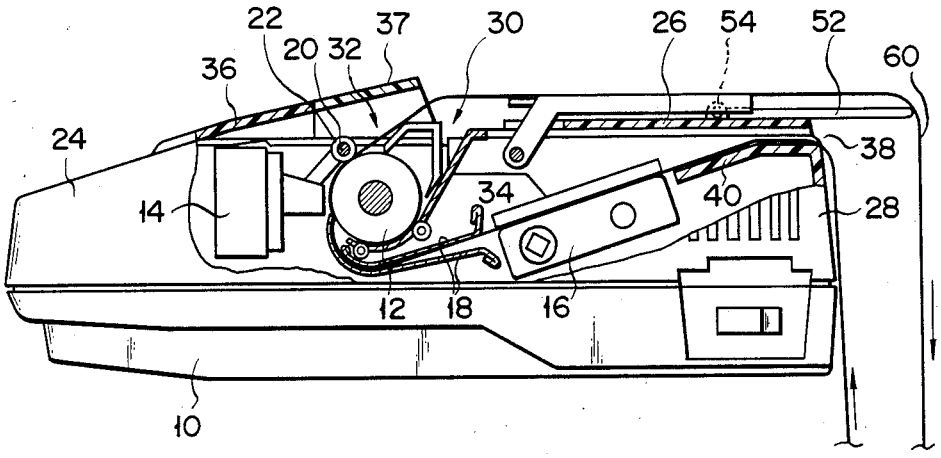

In printing on continuous sheet 60, separator 52 is rocked to the rear-end side of top plate 26 of cover 24 so that it comes into contact with plate 26. By doing this, separator 52 is held in a separating position where it extends horizontally, as shown in FIGS. 4 and 5. In this state, the top-side portions of separator 52 project rearward from the rear end of top plate 26. Meanwhile, guide 44 is rocked toward the rear end of plate 26 so that it takes a discharging position as shown in FIG. 5. In this position, the guide surface of guide 44 is situated horizontally. Continuous sheet 60 is fed from the lower portion of the printer, along rear plate 28 of cover 24, to be delivered to continuous-sheet feed aperture 38. Thereafter, sheet 60 is inserted into the inside space of cover 24 through aperture 38, and is transported along guide plate 40 to tractors 16. Then, sheet 60 is fed along guide plates 18 to platen 12 by tractors 16. A printed portion of continuous sheet 60 is discharged to the outside of cover 24 through discharge aperture 32, whereupon it is transported along the guide surface of guide 44 and separator 52, thus reaching the rear end of the printer. After clearing the top portions of separator 52, the printed sheet portion is transported vertically downward. Thus, on the side of rear plate 28 of cover 24, continuous sheet 60 is transported with its supply side and discharge side kept at a predetermined distance from each other.

Figure 6:
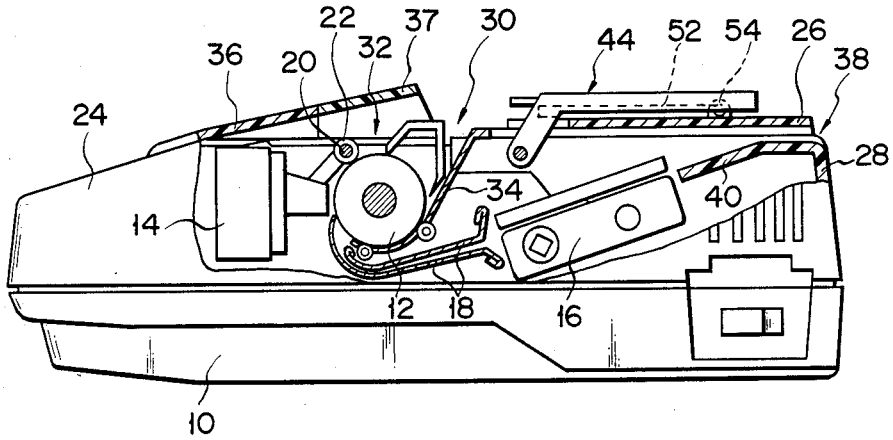

When the printer need not be operated for printing, separator 52 is rocked toward cut-sheet feed aperture 30 so that it touches top plate 26 of cover 24, and is kept in its rest position, as shown in FIG. 6. Guide 44 is rocked to the discharging position, where it lies flat on separator 52.

According to the printer constructed in this manner, cut-sheet guide 44 is rockable, and, in cut-sheet printing, is rocked to the guiding position to be held therein by separator 52. In the guiding position, guide 44 is inclined at a predetermined angle to top plate 26 of cover 24. In continuous-sheet printing, on the other hand, it is rocked to the discharging position where it lies parallel to top plate 26 and does not hinder the discharge of the continuous sheet. In this manner, guide 44 can be set easily to a predetermined position, depending on the type of the printing sheet used. In other words, guide 44 need not be attached to or detached from cover 24 with change of the sheet type. Thus, the printer can enjoy improved operating efficiency. When using the continuous sheet, moreover, separator 52 is rocked to the separating position where it projects from the rear end of cover 24, thereby separating the supply side and the discharge side of the sheet, on the side of rear plate 28 of the cover. In this case, the supply and discharge sides of the continuous sheet can not be in contact with one another, so that no extraordinary load can be produce on the supply side of the sheet. Thus, the continuous sheet can be fed steadily to the platen side, thereby ensuring stable printing operation as a whole.

When the printer is off use, moreover, those parts projecting from cover 24 can be eliminated by rocking guide 44 and separator 52 to their discharging position and rest position, respectively. Thus, the printer can assume a compact configuration.

It is to be understood that the present invention is not limited to the embodiment described above, and that various changes and modifications may be effected therein by one skilled in the art without departing from the scope or spirit of the invention.

For example, it is necessary only that the separator, when in its holding position, be able to hold the cut-sheet guide in the guiding position, and, when in the separating position, be able to separate the discharge side of the continuous sheet from the supply side thereof by projecting from the rear end of the cover. Instead of being comb-shaped, therefore, the separator may have any other suitable shapes, e.g., the shapes of U's or M's. Moreover, the separator may be formed of a plate member in place of a wire.

What is claimed is:

1. A printer for printing on a cut or continuous sheet, comprising:

a platen adapted to be wound with the sheet;

a printing head located to face the platen, for printing on the sheet wound on the platen;

a cover arranged so as to hide the platen and the printing head, said cover including a top plate with a rear end, a rear plate, a discharge aperture, and a cut-sheet feed aperture, the apertures being situated close to the platen, the rear plate extending substantially vertically downward from the rear end of the top plate and having a continuous-sheet feed aperture, whereby the platen discharges the printed sheet toward the rear end of the top plate from the discharge aperture;

a cut-sheet guide for guiding the cut-sheet to the platen through the cut-sheet feed aperture, the cut-sheet guide having a guide surface, a proximal end portion rockably mounted on the top plate near the cut-sheet feed aperture, and a distal end portion situated at a distance from the proximal end portion, the distance between the proximal and distal end portions being shorter than that between the proximal end portion of the cut-sheet guide and the rear end of the top plate, said cut-sheet guide being rockable between a feed position, in which the guide surface is inclined at a predetermined angle to the top plate, and a discharge position, in which the guide surface is situated substantially parallel to the top plate; and a separator having a proximal end portion rockably mounted on the top plate, and a distal end portion situated at a distance from the proximal end portion, the distance between the proximal and distal end portions of said separator is shorter than that between the proximal end portion of the separator and the cut-sheet feed aperture, and is longer than that between the proximal end portion of the separator and the rear end of the top plate of the cover, the separator being rockable among a holding position, in which the distal end portion engages and holds the cut-sheet guide in the feed position, a rest position in which the distal end portion of the separator is located near the cut-sheet feed aperture and the separator is substantially parallel to the top plate, and a separating position, in which the distal end portion projects from the rear end of the top plate, thereby delivering the continuous sheet, discharged from the discharge aperture, to a position spaced from the rear end of the top plate.

2. A printer according to claim 1, wherein said cut-sheet guide includes a pair of parallel frames spaced at a distance substantially equal to the length of the platen, and a rectangular guide plate fixed between the frames and having a side edge, extending parallel to the axis of the platen and situated close to the cut-sheet feed aperture, each of said frames having a lower end portion rockably supported by the cover.

3. A printer according to claim 1, wherein said separator is formed of a comb-shaped wire material, and has a pair of ends, constituting the proximal end portion, and a plurality of top portions constituting the distal end portion.

4. A printer according to claim 3, wherein said cut-sheet guide has a plurality of engaging portions capable of engaging the top portions of the separator.

5. A printer according to claim 1, which further comprises feeding means arranged inside the cover, for feeding to the platen the continuous sheet introduced into the inside space of the cover through the continuous-sheet feed aperture.

6. A printer according to claim 1, wherein said separator is disposed between said top plate and said cut-sheet guide when said separator is in said rest position and said cut sheet guide is in said discharge position.

* * * * *